US010248043B2

(12) United States Patent
Tetsuno et al.

(10) Patent No.: US 10,248,043 B2
(45) Date of Patent: Apr. 2, 2019

(54) IMAGE FORMING APPARATUS THAT PREVENTS TONER CHARGED WITH POLARITY OPPOSITE NORMAL CHARGING POLARITY FROM BEING COLLECTED

(71) Applicant: CANON KABUSHIKI KAISHA, Tokyo (JP)

(72) Inventors: Shuichi Tetsuno, Kawasaki (JP); Shinji Katagiri, Yokohama (JP); Takayuki Tanaka, Tokyo (JP); Tsuguhiro Yoshida, Yokohama (JP); Takahiro Ikeda, Oyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/816,818

(22) Filed: Nov. 17, 2017

(65) Prior Publication Data

US 2018/0149993 A1 May 31, 2018

(30) Foreign Application Priority Data

Nov. 29, 2016 (JP) ..... 2016-231525

(51) Int. Cl.
*G03G 15/02* (2006.01)
*G03G 21/00* (2006.01)

(52) U.S. Cl.
CPC ..... *G03G 15/0266* (2013.01); *G03G 15/0208* (2013.01); *G03G 15/0283* (2013.01); *G03G 21/0064* (2013.01)

(58) Field of Classification Search
CPC ..... G03G 15/0266; G03G 15/0208; G03G 15/0283; G03G 21/0005; G03G 21/0064; G03G 2221/0005
See application file for complete search history.

(56) References Cited

U.S. PATENT DOCUMENTS 5,541,717 A * 7/1996 Saito ..... G03G 21/0064 399/150
2003/0049048 A1* 3/2003 Yoshikawa ..... G03G 21/0064 399/129
2011/0116834 A1* 5/2011 Kinokuni ..... G03G 21/0064 399/129

FOREIGN PATENT DOCUMENTS

JP 5206767 B2 6/2013

* cited by examiner

*Primary Examiner* — Sophia S Chen
(74) *Attorney, Agent, or Firm* — Canon U.S.A., Inc. IP Division

(57) ABSTRACT

In a case where a collection mode in which an exposure unit forms a first potential on a photosensitive member and a developing unit collects discharging toner discharged from the developing unit to a position where the first potential is formed is executed, a potential forming unit forms, on an intermediate transfer member, a potential same as a normal charging polarity of toner and an absolute value greater than an absolute value of the first potential, and a charging power supply applies, to a charging member, a voltage having a polarity same as the normal charging polarity and an absolute value greater than an absolute value of the first potential.

27 Claims, 7 Drawing Sheets

○ NORMAL TONER (NEGATIVE POLARITY)

● REVERSAL TONER (POSITIVE POLARITY)

○ NORMAL TONER (NEGATIVE POLARITY)

● REVERSAL TONER (POSITIVE POLARITY)

IMAGE FORMING APPARATUS THAT PREVENTS TONER CHARGED WITH POLARITY OPPOSITE NORMAL CHARGING POLARITY FROM BEING COLLECTED

BACKGROUND OF THE INVENTION

Field of the Invention

The present disclosure relates to an electrophotographic image forming apparatus such as a copier and a printer.

Description of the Related Art

Conventionally, there are known image forming apparatuses in which a developing unit supplies toner to a photosensitive drum as a photosensitive member to form a toner image on the photosensitive drum, and the toner image formed on the photosensitive drum is transferred onto a transfer medium such as paper and an overhead projector (OHP) sheet or an intermediate transfer member such as an intermediate transfer belt. The developing unit includes a developer container for storing the toner, and a developing roller as a developing member for supplying the toner stored in the developer container to the photosensitive drum. Moreover, such an image forming apparatus has a known configuration to remove deteriorated toner carried by the developing roller. According to the configuration, the toner carried by the developing roller is discharged to the photosensitive drum, and the discharged toner is collected by a cleaning member disposed on the photosensitive drum. In the following description, toner discharged from a developing roller to a photosensitive drum is referred to as "discharging toner."

Japanese Patent No. 5206767 discusses an image forming apparatus with a cleaner-less configuration in which a cleaning member is not disposed on a photosensitive drum. Such an image forming apparatus executes a collection mode in which discharging toner discharged from a developing unit is collected by the developing unit again. According to the configuration, the discharging toner collected by the developing unit is stored in a developer container for storing toner to be supplied from a developing roller to a photosensitive drum at image formation.

However, in the configuration in which the discharging toner is collected in the developer container as discussed in Japanese Patent No. 5206767, deteriorated toner carried by the developing roller may be also collected in the developer container. In some cases, the deteriorated toner may include toner charged with a polarity (e.g., a positive polarity) opposite to a normal charging polarity (e.g., a negative polarity) of toner at image formation (hereinafter referred to as reversal toner). In a case where such reversal toner rubs against toner (hereinafter referred to as normal toner) that is not the reversal toner in the developer container, the reversal toner is further charged to the positive polarity side, and the normal toner is further charged to the negative polarity side in the developer container.

The reversal toner and the normal toner rub against each other in the developer container. This may cause the reversal toner and the normal toner to be excessively charged in the developer container. In such a case, when toner is supplied from the developing roller to the photosensitive drum, toner may be developed in a non-image forming portion of the photosensitive drum.

SUMMARY OF THE INVENTION

The present disclosure is directed to an image forming apparatus that prevents toner charged with a polarity opposite to a normal charging polarity from being collected by a developing unit in a case where a collection mode in which toner discharged from the developing unit to a photosensitive member is collected by the developing unit is executed.

According to an aspect of the present disclosure, an image forming apparatus includes a photosensitive member, a charging member configured to charge the photosensitive member, a charging power supply configured to apply a voltage to the charging member, an exposure unit configured to expose the photosensitive member, a developing unit configured to develop a toner image on the photosensitive member by supplying toner, an intermediate transfer member configured to form a transfer portion by contacting the photosensitive member and to receive the toner image transferred from the photosensitive member in the transfer portion, and a potential forming unit configured to form a potential of the intermediate transfer member in the transfer portion, wherein, in a case where a collection mode in which the exposure unit forms a first potential on the photosensitive member and the developing unit collects discharging toner discharged from the developing unit to a position where the first potential is formed is executed, the potential forming unit forms a potential having a polarity same as a normal charging polarity of toner and an absolute value greater than an absolute value of the first potential on the intermediate transfer member, and the charging power supply applies a voltage having a polarity same as the normal charging polarity and an absolute value greater than the absolute value of the first potential to the charging member.

Further features of the present disclosure will become apparent from the following description of exemplary embodiments with reference to the attached drawings.

DESCRIPTION OF THE EMBODIMENTS

Various exemplary embodiments are hereinafter described in detail with reference to the drawings. However, dimensions, materials, shapes, and relative arrangements of components described in the exemplary embodiments can be changed appropriately according to configurations or various conditions of an apparatus of the exemplary embodiments. Hence, description of the exemplary embodiments is not intended to limit the scope of the disclosure.

[Configuration of Image Forming Apparatus]

Figure 1:
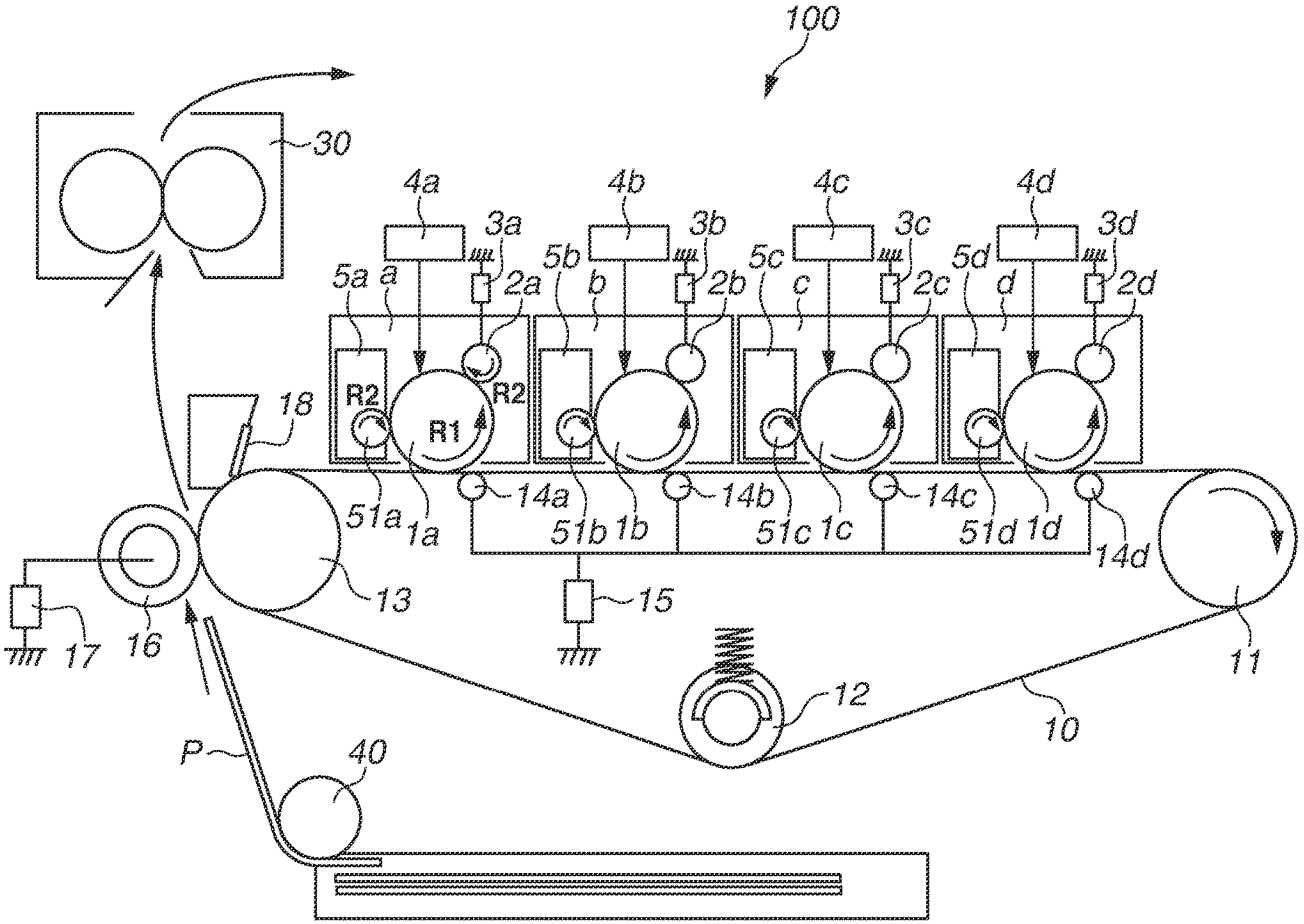
FIG. 1 is a schematic sectional view illustrating an image forming apparatus according to a first exemplary embodiment.
Figure 2:
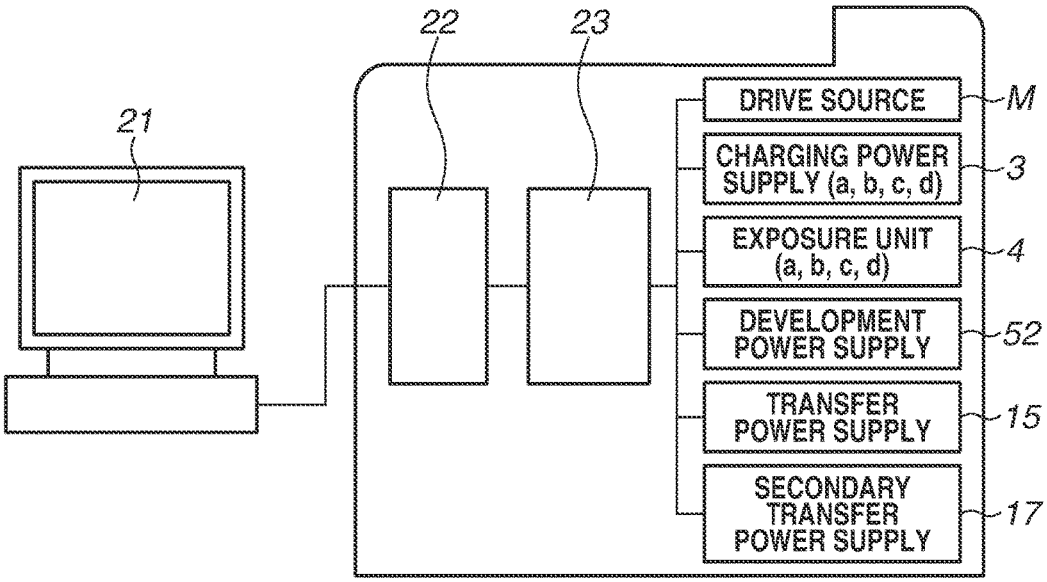
FIG. 2 is a block diagram illustrating a control system of the image forming apparatus according to the first exemplary embodiment.

A first exemplary embodiment is described below. FIG. 1 is a schematic sectional view illustrating a configuration of an image forming apparatus 100 according to the present exemplary embodiment. FIG. 2 is a block diagram illustrating a control system of the image forming apparatus 100 according to the present exemplary embodiment.

As illustrated in FIG. 2, the image forming apparatus 100 is connected to a personal computer 21 as a host device. An operation start instruction and an image signal from the personal computer 21 are transmitted to a controller circuit 23 as a control unit via an interface circuit 22 embedded in the image forming apparatus 100. The controller circuit 23 controls various units, so that image forming is executed in the image forming apparatus 100.

As illustrated in FIG. 1, the image forming apparatus 100 of the present exemplary embodiment is a tandem-type image forming apparatus including a plurality of image forming units a through d. The first, second, third, and fourth image forming units a, b, c, and d respectively form images with yellow (Y), magenta (M), cyan (C), and black (Bk) toners. These four image forming units a, b, c, and d are arranged side by side in a line and spaced a certain distance apart. Since each of the image forming units a, b, c, and d is substantially similar to every other except for the difference in color of toner contained therein, the image forming apparatus 100 of the present exemplary embodiment is hereinafter described using the first image forming unit a.

The first image forming unit a includes a photosensitive drum 1*a* as a drum-shaped photosensitive member, a charging roller 2*a* as a charging member, a charging power supply 3*a* for applying voltage to the charging roller 2*a*, an exposure unit 4*a*, and a developing unit 5*a*. The photosensitive drum 1*a* is an image bearing member that bears a toner image. The photosensitive drum 1*a* is rotated in a direction (a counterclockwise direction) indicated by an arrow R1 illustrated in FIG. 1 at a predetermined circumferential velocity by a driving force from a drive source M illustrated in FIG. 2. In the present exemplary embodiment, the image forming units a through d do not include cleaning members that contact the respective photosensitive drums 1*a* through 1*d*. That is, each of the image forming units a thorough d has a cleaner-less configuration.

When the controller circuit 23 illustrated in FIG. 2 receives an image signal, an image forming operation is started and the photosensitive drum 1*a* is rotated. When being rotated, the photosensitive drum 1*a* is uniformly charged with a predetermined potential having a predetermined polarity (a negative polarity in the present exemplary embodiment) by the charging roller 2*a*, and is exposed to light by the exposure unit 4*a* according to the image signal. Thus, an electrostatic latent image corresponding to a yellow component image in a target color image is formed on the photosensitive drum 1*a*. Subsequently, the electrostatic latent image is developed in a development position by the developing unit 5*a*, and visualized as a yellow toner image on the photosensitive drum 1*a*. In the present exemplary embodiment, a normal charging polarity of toner stored in the developing unit 5*a* is a negative polarity, and the electrostatic latent image is reversely developed by the charging roller 2*a* using toner charged with a polarity same as a charging polarity of the photosensitive drum 1*a*. However, the present exemplary embodiment is not limited thereto. The present exemplary embodiment can be applied to an image forming apparatus that positively develops an electrostatic latent image using toner charged with a polarity opposite to a charging polarity of the photosensitive drum 1*a*.

The charging roller 2*a* as a charging member is in contact with a surface of the photosensitive drum 1*a*. With rotation of the photosensitive drum 1*a*, the charging roller 2*a* is rotated by friction with the surface of the photosensitive drum 1*a*. Moreover, the charging roller 2*a* includes a metal shaft having a diameter of 5.5 mm, and a conductive elastic layer having a thickness of 1.5 mm and a volume resistivity of approximately $1\times10^6$ Ωcm on the metal shaft. The charging power supply 3*a* is connected to the metal shaft of the charging roller 2*a*. The charging power supply 3*a* is controlled by the controller circuit 23 to apply a predetermined voltage to the charging roller 2*a* according to an image forming operation.

When a voltage of −1200 [V] was applied from the charging power supply 3*a* to the charging roller 2*a*, a surface potential of the photosensitive drum 1*a* was approximately −700 [V] (measured by a surface electrometer Model 1344 manufactured by Trek, Inc.). Moreover, when electric discharge began between the charging roller 2*a* and the photosensitive drum 1*a*, a potential difference (an electric discharge threshold value) was approximately 500 [V]. In the present exemplary embodiment, the image forming units a through d respectively include charging power supplies 3*a* through 3*d*. However, the present exemplary embodiment is not limited thereto. Some of the image forming units may use a common charging power supply, or all of the image forming units may use a common charging power supply.

The exposure unit 4*a* includes a laser driver, a laser diode, a polygon mirror, and an optical lens. The exposure unit 4*a* emits a laser beam based on image information input from the personal computer 21 (FIG. 2) to form an electrostatic latent image on a surface of the photosensitive drum 1*a*. In the present exemplary embodiment, a light quantity of the exposure unit 4*a* is adjusted such that a latent image electric potential Vl of the photosensitive drum 1*a* is −300 [V] when the photosensitive drum 1*a* is exposed to the maximum quantity of light from the exposure unit 4*a*.

The developing unit 5*a* includes a developing roller 51*a* as a developing member (a toner bearing member), and yellow toner. The developing unit 5*a* supplies the toner to the photosensitive drum 1*a*, so that the electrostatic latent image formed on the photosensitive drum 1*a* is developed as a toner image. The developing roller 51*a* can be in contact with and be separated from the photosensitive drum 1*a*. The developing roller 51*a* supplies the toner in a state in which the developing roller 51*a* is in contact with the photosensitive drum 1*a* by a predetermined contact width. The developing roller 51*a* rotates in a direction R2 illustrated in FIG. 1 at a circumferential velocity higher than that of the photosensitive drum 1*a*.

The developing rollers 51*a* through 51*d* are connected to a development power supply 52 (illustrated in FIG. 2). The development power supply 52 is controlled by the controller circuit 23 to apply a predetermined voltage to each of the developing rollers 51*a* through 51*d* according to an image forming operation. In the present exemplary embodiment, the common development power supply 52 applies voltage to each of the developing rollers 51*a* through 51*d* of the respective image forming units a through d. However, the present exemplary embodiment is not limited thereto. Some of the image forming units a through d may use a common development power supply, or a separate development power supply is disposed for each of the developing rollers 51*a* through 51*d*.

The toner used in the present exemplary embodiment is non-magnetic one component toner manufactured by a suspension polymerization method. Moreover, a normal charging polarity of the toner is a negative polarity, and the toner has a volume average particle diameter of approximately 6.0 μm measured by a laser diffraction-type particle size distribution measurement device LS-230 manufactured by Beckman Coulter, Inc. Moreover, silicon oxide particles of approximately 1.5% with respect to a weight of the toner are attached to the toner surface to reform a surface property. The silicon oxide particle has a volume average particle diameter of approximately 20 nm.

An intermediate transfer belt 10 as an intermediate transfer member is an endless belt having conductivity provided by adding conductive agent to a resin material. The intermediate transfer belt 10 is tightly stretched by three shafts of stretching rollers 11, 12, and 13, and rotated at a circumferential velocity substantially similar to that of each of the photosensitive drums 1*a* through 1*d*. The intermediate transfer belt 10 contacts the photosensitive drum 1*a* to form a primary transfer portion as a transfer portion. The yellow toner image formed on the photosensitive drum 1*a* is primarily transferred from the photosensitive drum 1*a* to the intermediate transfer belt 10 when passing the transfer portion.

On an inner circumferential surface side of the intermediate transfer belt 10, a metal roller 14*a* as a transfer member is disposed at a position opposite the photosensitive drum 1*a* via the intermediate transfer belt 10. The metal roller 14*a* is connected to a transfer power supply 15 as a potential forming unit. The metal roller 14*a* is disposed on a downstream side of the photosensitive drum 1*a* in a direction of movement of the intermediate transfer belt 10. Moreover, the metal roller 14*a* includes a round bar made of stainless used steel (SUS) and plated with nickel. The SUS-made round bar has a straight shape and an outer diameter of 6 mm. The metal roller 14*a* contacts the intermediate transfer belt 10 across a predetermined area in a longitudinal direction perpendicular to the direction of movement of the intermediate transfer belt 10, and is rotated with the rotation of the intermediate transfer belt 10.

When the transfer power supply 15 controlled by the controller circuit 23 applies voltage to the metal roller 14*a*, a potential is formed on the intermediate transfer belt 10 having conductivity, and the yellow toner image is primarily transferred from the photosensitive drum 1*a* to the intermediate transfer belt 10. In the present exemplary embodiment, voltage is applied to the metal rollers 14*a* through 14*d* from the common transfer power supply 15. However, the present exemplary embodiment is not limited thereto. A separate transfer power supply is disposed for each of the metal rollers 14*a* through 14*d*, or a common transfer power supply is disposed for only some of the metal rollers 14*a* through 14*d*.

Similarly, the second, third, and forth image forming units b, c, and d respectively form a toner image of magenta as the second color, a toner image of cyan as the third color, and a toner image of black as the fourth color, and then these toner images are sequentially superimposed and primarily transferred to the intermediate transfer belt 10. Accordingly, the four-color toner image corresponding to the target color image is formed on the intermediate transfer belt 10. Subsequently, the four-color toner image carried by the intermediate transfer belt 10 is secondarily transferred in a collective manner to a surface of a transfer medium P such as paper and an OHP sheet fed by a feed unit 40 when the four-color toner image is passing a secondary transfer portion formed between a secondary transfer roller 16 and the intermediate transfer belt 10 contacting each other.

The secondary transfer roller 16 as a secondary transfer member has an outer diameter of 18 mm. The secondary transfer roller 16 includes a nickel plated steel bar having an outer diameter of 6 mm, and the nickel plated steel bar is covered with foam sponge material containing nitrile-butadiene rubber (NBR) and epichlorohydrin rubber as main components. The foam sponge material has a volume resistivity and a thickness that are respectively adjusted to $10^8$ Ω·cm and 6 mm. Moreover, the foam sponge material has a rubber hardness of 30° (ASKER Durometer Type C). The secondary transfer roller 16 is in contact with an outer circumferential surface of the intermediate transfer belt 10, and presses the stretching roller 13 as an opposed member via the intermediate transfer belt 10 with a pressure of approximately 50 N to form the secondary transfer portion. The secondary transfer roller 16 is connected to a secondary transfer power supply 17. The secondary transfer power supply 17 applies voltage to the secondary transfer roller 16, so that the toner image is secondarily transferred from the intermediate transfer belt to the transfer medium P in the secondary transfer portion. The secondary transfer power supply 17 can output a voltage in a range of 100 [V] to 4000 [V].

After the four-color toner image carried by the intermediate transfer belt 10 is transferred to the transfer medium P in the secondary transfer portion, the transfer medium P is conveyed to a fixing unit 30. The fixing unit 30 applies heat and pressure to fuse and mix the toner of four colors, thereby fixing the four-color image on the transfer medium P. A cleaning unit 18 cleans and removes toner remaining on the intermediate transfer belt 10 subsequent to the secondary transfer. The cleaning unit 18 is disposed opposite to the stretching roller 13 via the intermediate transfer belt 10, and serves as a collection member for collecting the toner remaining on the intermediate transfer belt 10. Moreover, the cleaning unit includes a cleaning blade that contacts an outer circumferential surface of the intermediate transfer belt 10, and a waste toner container in which the toner removed from the intermediate transfer belt 10 by the cleaning blade is stored.

The image forming apparatus 100 of the present exemplary embodiment has the cleaner-less configuration in which a member for collecting toner is not disposed in a path before the toner remaining on the photosensitive drum 1*a* reaches a charging portion in which the charging roller 2*a* and the photosensitive drum 1*a* contact each other after passing the primary transfer portion. Hence, the toner remaining on the photosensitive drum 1*a* after the toner image is primarily transferred from the photosensitive drum 1*a* to the intermediate transfer belt 10 passes the charging portion and then is collected by the developing unit 5*a*.

Therefore, the image forming apparatus 100 of the present exemplary embodiment forms a full color print image by performing the above operations.

[Toner Discharge Control]

The image forming apparatus 100 of the present exemplary embodiment can execute a collection mode in which toner borne by the developing roller is discharged to the photosensitive drum, the photosensitive drum is rotated to allow the discharged toner to reach the developing unit again, and the developing units collects the discharged toner. Hereafter, operations and control performed by the image forming unit a of the image forming apparatus 100 according to the present exemplary embodiment when a collection mode is executed are described with reference to FIGS. 3A through 3G and FIG. 4. In the following description, toner discharged from the developing roller 51*a* to the photosensitive drum 1*a* is referred to as discharging toner.

Figure 3A:
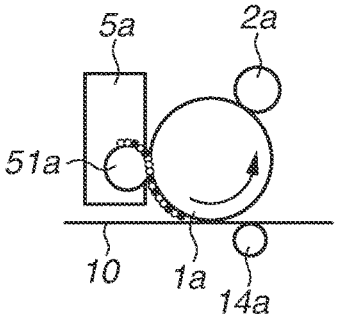
FIGS. 3A through 3G are schematic diagrams illustrating movement of discharging toner in a collection mode according to the first exemplary embodiment.
Figure 3B:
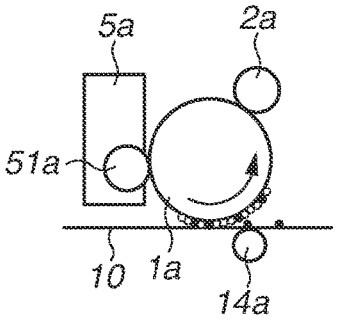
Figure 3C:
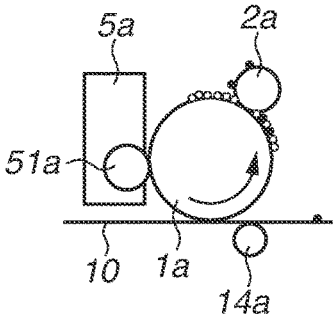
Figure 3D:
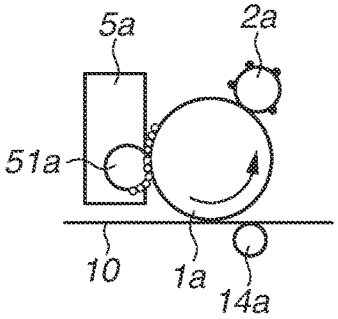
Figure 3E:
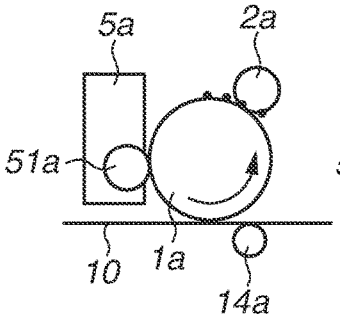
Figure 3F:
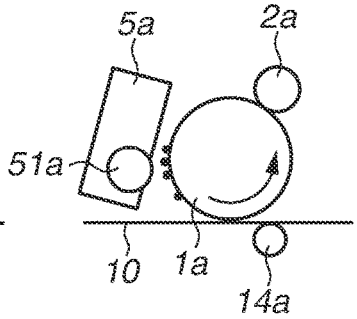
Figure 3G:
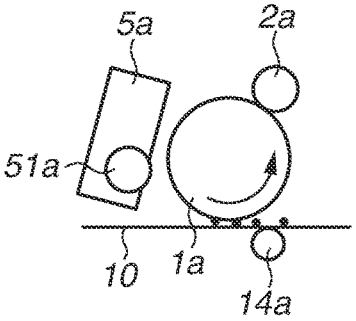
Figure 4:
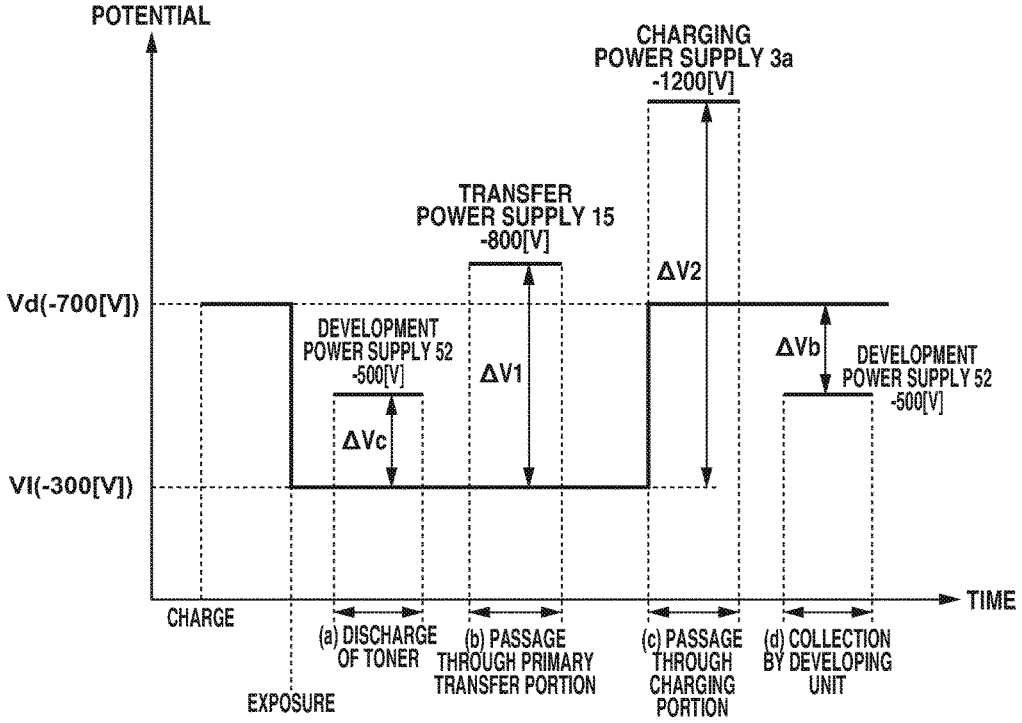
FIG. 4 is a schematic diagram illustrating a potential of a photosensitive member in the collection mode according to the first exemplary embodiment.

FIGS. 3A through 3G are schematic diagrams illustrating movement of discharging toner when the collection mode is executed, and FIG. 4 is a schematic diagram illustrating a potential of a photosensitive member in the collection mode. The processes (a) through (d) in FIG. 4 respectively correspond to FIGS. 3A through 3D.

As illustrated in FIG. 4, when an operation in the collection mode is started, the photosensitive drum 1*a* is uniformly charged with a predetermined potential having a negative polarity by the charging roller 2*a* while being rotated, and then is exposed by the exposure unit 4*a*. Accordingly, a latent image electric potential Vl (a first potential) is formed on the photosensitive drum 1*a*. In the present exemplary embodiment, after a background potential Vd of −700 [V] is formed on the photosensitive drum 1*a* by the charging roller 2*a*, the latent image electric potential Vl of −300 [V] is formed on the photosensitive drum 1*a* by the exposure unit 4*a*.

Subsequently, as illustrated in FIG. 3A, the toner borne by the developing roller 51*a* is discharged to the photosensitive drum 1*a* at a position where the developing roller 51*a* and the photosensitive drum 1*a* contact each other. Herein, as illustrated in FIG. 4, the development power supply 52 is applying a voltage of −500 [V] to the developing roller 51*a*, so that the toner borne by the developing roller 51*a* is discharged to the photosensitive drum 1*a* by a potential difference ΔVc formed between the photosensitive drum 1*a* and the developing roller 51*a*. In the present exemplary embodiment, a voltage to be applied from the development power supply 52 to the developing roller 51*a* is set to −500 [V] such that the potential difference ΔVc has an absolute value of 200 [V].

Herein, a normal charging polarity of the discharging toner is a negative polarity. However, the toner discharged from the developing roller 51*a* may include toner charged with a positive polarity. Hereinafter, discharging toner charged with a negative polarity is referred to as normal toner, whereas discharging toner charged with a positive polarity is referred to as reversal toner. In FIGS. 3A through 3G, a white circle indicates the normal toner, and a black circle indicates the reversal toner.

As illustrated in FIG. 4, when the discharging toner passes the primary transfer portion, the transfer power supply 15 applies a voltage of −800 [V] to the metal roller 14*a*. This forms a potential difference ΔV1 between a potential formed on the intermediate transfer belt 10 and a potential of the photosensitive drum 1*a* in the primary transfer portion such that reversal toner is electrostatically moved to the intermediate transfer belt 10. As a result, as illustrated in FIG. 3B, the normal toner passes the primary transfer portion while remaining on the photosensitive drum 1*a*, and one portion of the reversal toner is moved from the photosensitive drum 1*a* to the intermediate transfer belt 10. The reversal toner moved to the intermediate transfer belt 10 is collected by the cleaning unit 18 disposed on a downstream side of the secondary transfer portion in a direction of movement of the intermediate transfer belt 10.

In the present exemplary embodiment, a potential is formed on the intermediate transfer belt 10 by the transfer power supply 15 such that an absolute value of the potential difference ΔV1 is 500 [V]. However, the reversal toner can be transferred from the photosensitive drum 1*a* to the intermediate transfer belt 10 as long as a potential formed on the intermediate transfer belt 10 has a negative polarity and an absolute value greater than that of the latent image electric potential Vl of the photosensitive drum 1*a*. Since the reversal toner is charged with the positive polarity, the reversal toner is electrostatically attracted to the intermediate transfer belt 10 on which the negative polarity potential having an absolute value greater than an absolute value of the potential of the photosensitive drum 1*a* is formed.

A transfer rate at transfer of the reversal toner from the photosensitive drum 1*a* to the intermediate transfer belt 10 depends on a degree of the potential difference ΔV1. If an absolute value of the potential difference ΔV1 is smaller than an absolute value of an electric discharge threshold value between the intermediate transfer belt 10 and the photosensitive drum 1*a* in the primary transfer portion, a transfer rate of the reversal toner increases as the absolute value of the potential difference ΔV1 becomes greater. On the other hand, if an absolute value of the potential difference ΔV1 is greater than the absolute value of the electric discharge threshold value between the intermediate transfer belt 10 and the photosensitive drum 1*a* in the primary transfer portion, a transfer rate of the reversal toner decreases as the absolute value of the potential difference ΔV1 becomes greater. This is because electric discharge generated in the primary transfer portion causes the reversal toner borne by the photosensitive drum 1*a* to be charged. Therefore, in the present exemplary embodiment, a voltage to be applied from the transfer power supply 15 to the metal roller 14*a* is set in terms of a reversal toner efficiency such that an absolute value of the potential difference ΔV1 is a value before or after the absolute value of the electric discharge threshold value between the intermediate transfer belt 10 and the photosensitive drum 1*a* in the primary transfer portion.

Next, as illustrated in FIG. 3C, the discharging toner having passed the primary transfer portion passes a position (hereinafter referred to as a charging portion) where the charging roller 2*a* and the photosensitive drum 1*a* contact each other. As illustrated in FIG. 4, when the discharging toner passes the charging portion, the charging power supply 3*a* applies a voltage of −1200 [V] to the charging roller 2*a*. Such application of the voltage forms a potential difference ΔV2 between a potential of the charging roller 2*a* and a potential of the photosensitive drum 1*a* such that the reversal toner is electrostatically attracted to the charging roller 2*a*. As a result, as illustrated in FIG. 3C, the reversal toner can be moved to the charging roller 2*a*, whereas the normal toner remains on the photosensitive drum 1*a* and passes the charging portion. The reversal toner moved to the charging roller 2*a* undergoes processes in FIGS. 3E through 3G described below, and then is collected by the cleaning unit 18.

In the present exemplary embodiment, the charging power supply 3*a* applies voltage to the charging roller 2*a* such that an absolute value of the potential difference ΔV2 is 900 [V]. However, the reversal toner can be moved to the charging roller 2*a* by electrostatic force as long as a voltage to be applied to the charging roller 2*a* by the charging power supply 3*a* has a negative polarity and an absolute value thereof is greater than an absolute value of the latent image electric potential Vl of the photosensitive drum 1*a*.

Similar to the potential difference ΔV1, a movement rate at movement of the reversal toner from the photosensitive drum 1*a* to the charging roller 2*a* depends on a degree of the potential difference ΔV2, and an absolute value of the potential difference ΔV2 is preferably set to about an absolute value of the electric discharge threshold value between the charging roller 2*a* and the photosensitive drum 1*a*. However, a process for applying voltage from the charging power supply 3*a* to the charging roller 2*a* also has a function of charging the photosensitive drum 1*a* for a process (described below) for collecting the discharging toner in the developing unit 5*a*. Thus, in the present exemplary embodiment, a voltage to be applied from the charging power supply 3*a* to the charging roller 2*a* is set such that an absolute value of the potential difference ΔV2 is 900 [V] that is greater than an absolute value of the electric discharge threshold value between the charging roller 2*a* and the photosensitive drum 1*a*.

The charging power supply 3*a* applies a voltage of −1200 [V] to the charging roller 2*a*, thereby charging a surface of the photosensitive drum 1*a* having passed the charging portion to −700 [V]. In the present exemplary embodiment, before the discharging toner remaining on the photosensitive drum 1*a* reaches a position where the developing roller 51*a* and the photosensitive drum 1*a* contacts each other, the development power supply 52 applies a voltage of −500 [V] to the developing roller 51*a*. Accordingly, as illustrated in FIG. 3D, the discharging toner remaining on the photosensitive drum 1*a* is collected by the developing unit 5*a*. Herein, as illustrated in FIG. 4, a potential difference ΔVb is formed between the developing roller 51*a* to which the voltage of −500[V] has been applied by the development power supply 52 and the photosensitive drum 1*a*. With the potential difference ΔVb, the discharging toner is electrostatically collected by the developing roller 51*a*.

A collection efficiency at collection of the discharging toner by the developing unit 5*a* depends on a degree of the potential difference ΔVb. If an absolute value of the potential difference ΔVb is smaller than an absolute value of the electric discharge threshold value between the developing roller 51*a* and the photosensitive drum 1*a*, an electric filed allowing the discharging toner to be moved toward the developing roller 51*a* becomes strong as the absolute value of the potential difference ΔVb becomes greater. Hence, the collection efficiency is enhanced. On the other hand, if the absolute value of the potential difference ΔVb is greater than the absolute value of the electric discharge threshold value between the developing roller 51*a* and the photosensitive drum 1*a*, the collection efficiency is lowered as the absolute value of the potential difference ΔVb becomes greater. This is because electric discharge generated between the developing roller 51*a* and the photosensitive drum 1*a* causes the discharging toner to be charged. In the present exemplary embodiment, a voltage to be applied from the development power supply 52 to the developing roller 51*a* is set to −500 [V] such that an absolute value of the potential difference ΔVb is 200 [V].

Next, a processing for collecting the reversal toner moved to the charging roller 2*a* by the cleaning unit 18 is described with reference to FIGS. 3E through 3G.

As illustrated in FIG. 3E, after the discharging toner is collected by the developing unit 5*a*, the reversal toner moved to the charging roller 2*a* is discharged. Herein, a background potential Vd of −700 [V] is formed on a surface of the photosensitive drum 1*a*. In the present exemplary embodiment, a voltage to be applied from the charging power supply 3*a* to the charging roller 2*a* is zero [V], and the reversal toner charged with a positive polarity is electrostatically moved from the charging roller 2*a* to the photosensitive drum 1*a*.

If a potential difference between a potential formed on the charging roller 2*a* by the voltage applied by the charging power supply 3*a* and a background potential Vd of the photosensitive drum 1*a* is small, movement of the reversal toner to the photosensitive drum 1*a* is difficult. Moreover, if a potential difference between a potential formed on the charging roller 2*a* and a background potential Vd of the photosensitive drum 1*a* is excessively large, electric discharge occurs in the charging portion. This causes the reversal toner to be charged, and thus movement of the reversal toner to the photosensitive drum 1*a* becomes difficult. Therefore, a potential of the charging roller 2*a* is preferably set such that an absolute value of a potential difference between a potential formed on the charging roller 2*a* and a background potential Vd is a value before or after an absolute value of the electric discharge threshold value between the charging roller 2*a* and the photosensitive drum 1*a*.

Next, as illustrated in FIG. 3F, before the reversal toner discharged from the charging roller 2*a* passes a position where the developing roller 51*a* and the photosensitive drum 1*a* contact each other, the developing roller 51*a* is separated from the photosensitive drum 1*a*. Accordingly, the reversal toner discharged from the charging roller 2*a* is not collected by the developing unit 5*a* and passes the developing unit 5*a*.

In the present exemplary embodiment, the developing roller 51*a* is separated from the photosensitive drum 1*a* such that the reversal toner discharged from the charging roller 2*a* is not collected by the developing unit 5*a*. However, the present exemplary embodiment is not limited thereto. For example, the developing roller 51*a* may not necessarily be separated from the photosensitive drum 1*a* as long as a potential difference between a potential formed on the developing roller 51*a* and a background potential Vd of the photosensitive drum 1*a* enables the reversal toner to remain attracted to the photosensitive drum 1*a*.

Subsequently, as illustrated in FIG. 3G, the reversal toner having passed the developing unit 5*a* is moved from the photosensitive drum 1*a* to the intermediate transfer belt 10 in the primary transfer portion. Herein, the reversal toner can be moved from the photosensitive drum 1*a* to the intermediate transfer belt 10 as long as a potential formed on the intermediate transfer belt 10 has a negative polarity and an absolute value thereof is greater than an absolute value of the background potential Vd of the photosensitive drum 1*a*.

In the primary transfer portion, a potential difference between a potential formed on the intermediate transfer belt 10 by the voltage applied to the metal roller 14*a* by the transfer power supply 15 and a background potential Vd of the photosensitive drum 1*a* may be small. In such a case, a movement rate of the reversal toner moving to the intermediate transfer belt 10 is lowered. Moreover, a potential difference between a potential formed on the intermediate transfer belt 10 and a background potential Vd of the photosensitive drum 1*a* may be excessively large. In such a case, electric discharge occurs in the primary transfer portion, and the reversal toner is charged. This degrades a movement rate of the reversal toner moving to the intermediate transfer belt 10. Therefore, a voltage to be applied to the metal roller 14*a* is preferably set such that an absolute value of a potential difference between a potential formed on the intermediate transfer belt 10 and a background potential Vd of the photosensitive drum 1*a* is a value before or after an absolute value of an electric discharge threshold value between the intermediate transfer belt 10 and the photosensitive drum 1*a*.

Subsequently, the reversal toner moved to the intermediate transfer belt 10 is collected by the cleaning unit 18 disposed on a downstream side of the secondary transfer portion in a direction of movement of the intermediate transfer belt 10. Then, the collection mode according to the present exemplary embodiment ends.

Therefore, in the present exemplary embodiment as described above, when the collection mode in which discharging toner once discharged from the developing unit 5*a* is collected by the developing unit 5*a* is executed, reversal toner included in the discharging toner can be moved to the intermediate transfer belt 10 and the charging roller 2*a*. That is, in the present exemplary embodiment, reversal toner is moved to the intermediate transfer belt when discharging toner passes the primary transfer portion, and the reversal toner is moved to the charging roller 2*a* when the discharging toner passes the charging portion. Hence, the reversal toner in the discharging toner is collected twice, preventing the reversal toner charged with a polarity opposite to a normal charging polarity of the toner from being collected by the developing unit 5*a* in the collection mode.

The image forming apparatus 100 executes the collection mode each time an amount of deteriorated toner such as reversal toner increases, so that developing ability by which toner is supplied from the developing unit 5*a* to the photosensitive drum 1*a* to develop a toner image can be maintained and good for a long period. The collection mode can be executed after an image forming operation is finished to prevent the start of the image forming operation from being delayed. Alternatively, the collection mode can be executed in an interval between sheets of transfer media P when images are successively formed on a plurality of transfer media P. Moreover, the collection mode can be executed even when the developing unit 5*a* is new. For example, when developing unit 5*a* is new, the developing roller 51*a* may contain reversal toner. In such a case, execution of the collection mode can maintain good developing ability.

The present exemplary embodiment has been described using the collection mode in the image forming unit a. However, a collection mode can be performed in each of the image forming units b through d as similar to the image forming unit a. Moreover, an operation and control for executing the collection mode for each of the image forming units b through d are similar to those for the image forming unit a.

A second exemplary embodiment is hereinafter described. The first exemplary embodiment has been described using a configuration in which the charging power supply 3*a* applies a voltage of −1200 [V] to the charging roller 2*a* during a period when discharging toner passes through a charging portion, and reversal toner is then moved to the charging roller 2*a*. In the second exemplary embodiment, on the other hand, the charging power supply 3*a* applies a voltage of −800 [V] having an absolute value smaller than an absolute value of the voltage of −1200 [V] to the charging roller 2*a*. A configuration of an image forming apparatus 100 of the present exemplary embodiment is similar to that of the first exemplary embodiment. Moreover, control performed in a collection mode in the present exemplary embodiment is similar to that in the first exemplary embodiment except for a voltage applied from the charging power supply 3*a* to the charging roller 2*a* during passage of discharging toner through a charging portion, and a voltage applied from the development power supply 52 to the developing roller 51*a* during collection of the discharging toner by the developing unit 5*a*. Therefore, components similar to the first exemplary embodiment are given the same reference numerals and descriptions thereof are omitted.

Similar to the first exemplary embodiment, the present exemplary embodiment is described using an example of control performed when the collection mode is executed in the image forming unit a. However, a collection mode can be executed in each of image forming units b through d by performing control similar to that performed for the image forming unit a.

Figure 5:
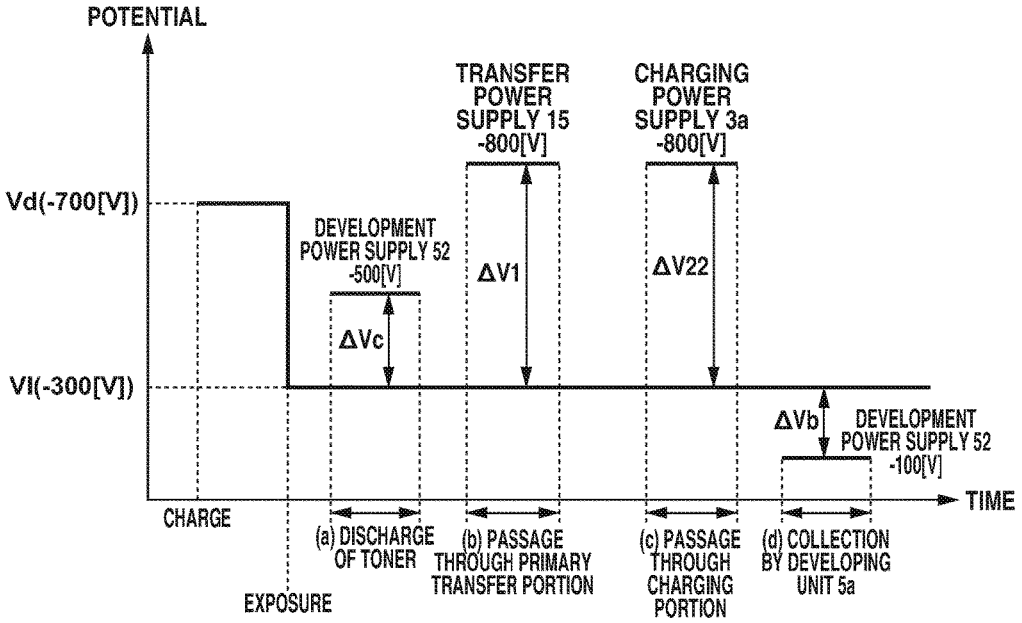
FIG. 5 is a schematic diagram illustrating a potential of a photosensitive member in a collection mode according to a second exemplary embodiment.

FIG. 5 is a schematic diagram illustrating a potential of a photosensitive member in a collection mode according to the present exemplary embodiment. The processes (a) through (d) in FIG. 5 respectively correspond to operations in FIGS. 3A through 3D.

In the present exemplary embodiment, as indicated in the process (c) of FIG. 5, the charging power supply 3*a* applies a voltage of −800 [V] to the charging roller 2*a* while discharging toner having passed the primary transfer portion passes the charging portion. This forms a potential difference ΔV22 between a potential of the charging roller 2*a* and a latent image electric potential Vl of the photosensitive drum 1*a* such that reversal toner is electrostatically attracted to the charging roller 2*a*.

Herein, an absolute value of the potential difference ΔV22 is a value before or after 500 [V] that is an absolute value of an electric discharge threshold value between the charging roller 2*a* and the photosensitive drum 1*a*. That is, a voltage to be applied from the charging power supply 3*a* to the charging roller 2*a* is set to −800 [V], so that an absolute value of the potential difference ΔV22 can be set to a value around an absolute value of the electrical discharge threshold value between the charging roller 2*a* and the photosensitive drum 1*a*. Hence, a movement rate at movement of the reversal toner from the photosensitive drum 1*a* to the charging roller 2*a* can be increased.

As illustrated in FIG. 5, when the charging power supply 3*a* applies a voltage of −800 [V] to the charging roller 2*a* in the charging portion, the potential difference ΔV22 does not reach a potential difference allowing the charging roller 2*a* to charge the photosensitive drum 1*a*. Thus, even when the photosensitive drum 1*a* passes the charging portion, a surface of the photosensitive drum 1*a* is not charged by the charging roller 2*a*, and a surface potential remains at −300 [V]. Subsequently, the discharging toner reaches a position in which the developing roller 51*a* and the photosensitive drum 1*a* contact each other.

In the present exemplary embodiment, when the discharging toner is collected by the developing unit 5*a*, the development power supply 52 applies a voltage of −100 [V] to the developing roller 51*a*. Such voltage application forms a potential difference ΔVb of 200 [V] between the developing roller 51*a* and the photosensitive drum 1*a*. With the potential difference ΔVb, the discharging toner is electrostatically collected by the developing roller 51*a*.

Subsequently, the reversal toner moved to the charging roller 2*a* is collected by a cleaning unit 18 according to the operation and the control similar to the first exemplary embodiment. Then, the collection mode of the present exemplary embodiment ends. Therefore, an effect similar to that of the first exemplary embodiment can be obtained by the present exemplary embodiment.

Next, a third exemplary embodiment is described. The first exemplary embodiment has been described using a configuration in which reversal toner is moved to the intermediate transfer belt 10 while discharging toner is passing the primary transfer portion, and the reversal toner is moved to the charging roller 2*a* while the discharging toner is passing the charging portion, thereby collecting the reversal toner in the discharging toner twice. In the third exemplary embodiment, on the other hand, when the collection mode is executed, the photosensitive drum 1*a* is rotated such that discharging toner passes a primary transfer portion twice. A configuration of an image forming apparatus 100 of the present exemplary embodiment is similar to that of the first exemplary embodiment except for a case in which the discharging toner passes the primary transfer portion twice when the collection mode is executed. Components similar to the first exemplary embodiment are given the same reference numerals and descriptions thereof are omitted.

Similar to the first exemplary embodiment, the present exemplary embodiment is described using an example of control performed when the collection mode is executed in the image forming unit a. However, the collection mode can be executed in each of image forming units b through d by performing control similar to that performed for the image forming unit a.

Hereinafter, an operation and control performed when the collection mode is executed in the image forming unit a of the present exemplary embodiment is described with reference to FIGS. 6A through 6G and FIG. 7. FIGS. 6A through 6G are schematic diagrams illustrating movement of discharging toner when the collection mode is executed according to the present exemplary embodiment. FIG. 7 is a schematic diagram illustrating a potential of a photosensitive member in the collection mode. The processes (a) through (g) in FIG. 7 respectively correspond to FIGS. 6A through 6G.

Figure 6A:
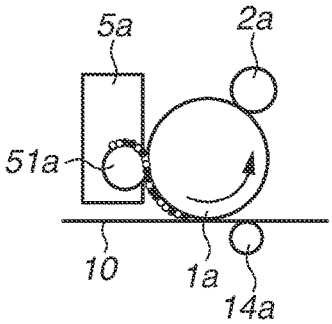
FIGS. 6A through 6G are schematic diagrams illustrating movement of discharging toner in a collection mode according to a third exemplary embodiment.
Figure 6B:
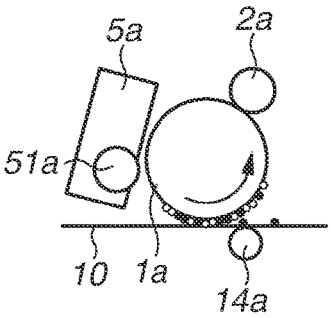
Figure 7:
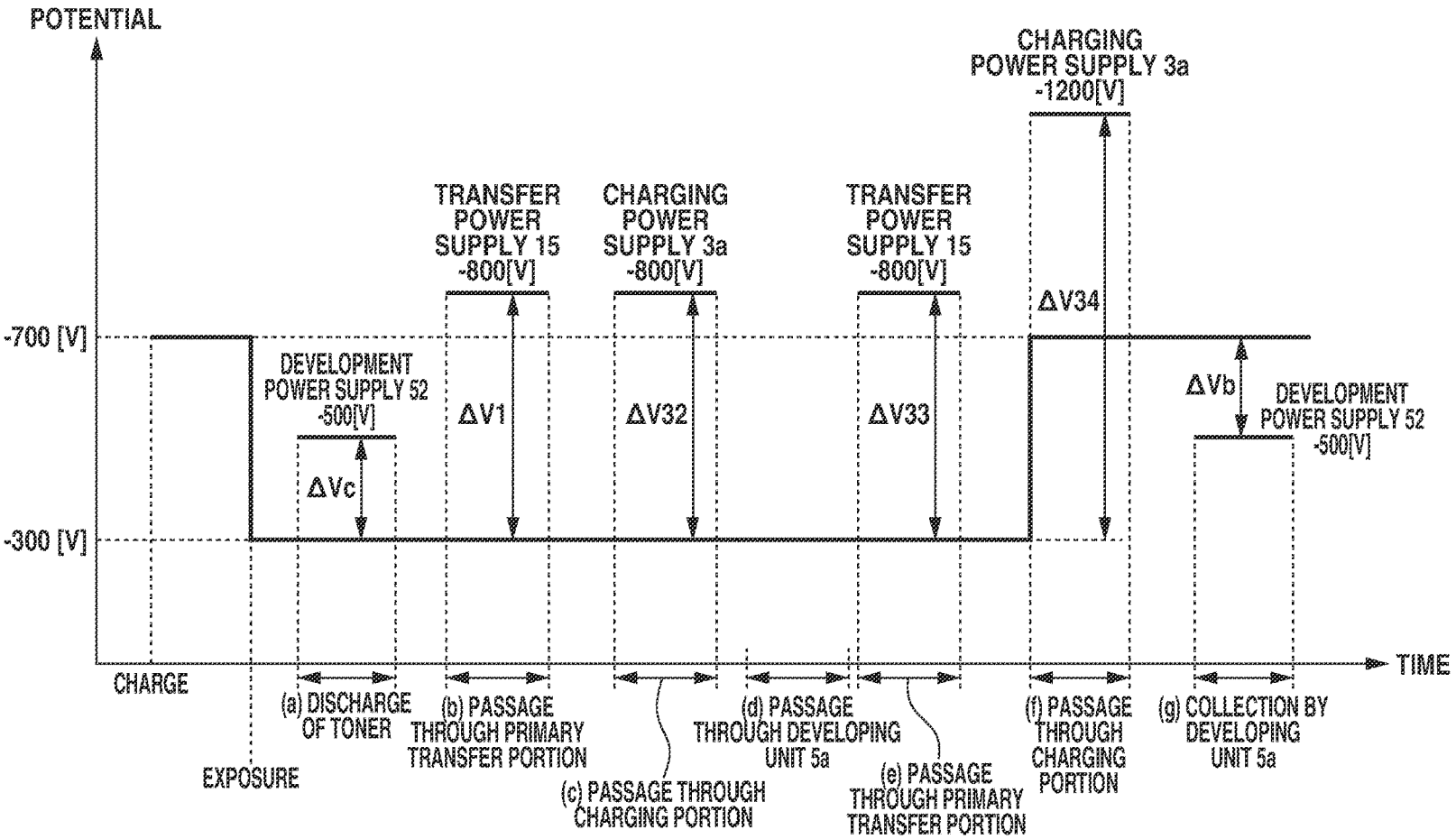
FIG. 7 is a schematic diagram illustrating a potential of a photosensitive member in the collection mode according to the third exemplary embodiment.

In the present exemplary embodiment, as illustrated in FIG. 6B, a developing roller 51*a* of a developing unit 5*a* is separated from the photosensitive drum 1*a* after the developing unit 5*a* discharges discharging toner. Then, as similar to the first exemplary embodiment, the transfer power supply 15 applies a voltage of −800 [V] to the metal roller 14*a* while the discharging toner passes the primary transfer portion, so that a potential difference ΔV1 is formed and reversal toner is moved to the intermediate transfer belt 10.

In the present exemplary embodiment, a potential is formed on the intermediate transfer belt 10 by the transfer power supply 15 such that an absolute value of the potential difference ΔV1 is 500 [V]. However, the reversal toner can be moved from the photosensitive drum 1*a* to the intermediate transfer belt 10 as long as a potential to be formed on the intermediate transfer belt 10 has a negative polarity and an absolute value thereof is greater than an absolute value of a latent image electric potential Vl of the photosensitive drum 1*a*.

Figure 6C:
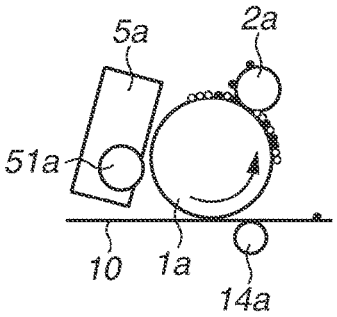

As illustrated in FIG. 7, the charging power supply 3*a* applies a voltage of −800 [V] to the charging roller 2*a* while discharging toner having passed the primary transfer portion once passes the charging portion. Accordingly, a potential difference ΔV32 is formed between a potential of the charging roller 2*a* and a latent image electric potential V1 (−300 [V]) of the photosensitive drum 1*a*. As a result, as illustrated in FIG. 6C, the reversal toner can be electrostatically moved to the charging roller 2*a*.

Figure 6D:
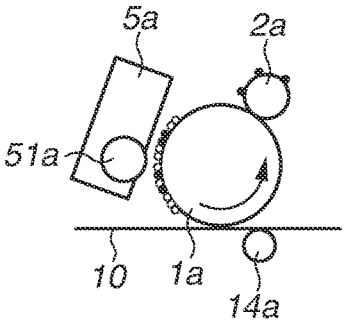
Figure 6E:
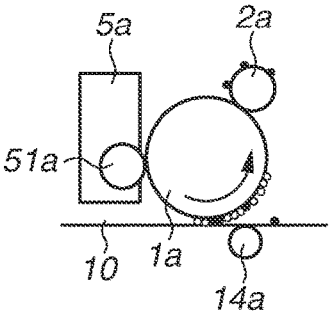

Subsequently, as illustrated in FIG. 6D, since the developing roller 51*a* is separated from the photosensitive drum 1*a*, the discharging toner passes a position where the photosensitive drum 1*a* can contact the developing roller 51*a*, and thus is not collected by the developing unit 5*a*. Consequently, as illustrated in FIG. 6E, the discharging toner reaches the primary transfer portion again. In the present exemplary embodiment, the developing unit 5*a* contacts the photosensitive drum 1*a* after the discharging toner reaches a position where the discharging toner is not collected by the developing unit 5*a*.

As illustrated in FIG. 7, the transfer power supply 15 applies a voltage of −800 [V] to the metal roller 14*a* while the discharging toner is passing the primary transfer portion for the second time. Accordingly, a potential difference ΔV33 enabling the reversal toner to be electrostatically moved from the photosensitive drum 1*a* to the intermediate transfer belt 10 is formed between the potential of the intermediate transfer belt 10 and the latent image electric potential Vl of the photosensitive drum 1*a*. As a result, as illustrated in FIG. 6E, the reversal toner is electrostatically moved to the intermediate transfer belt 10.

Figure 6F:
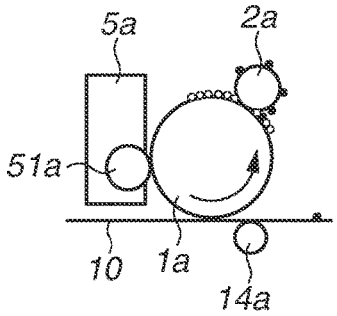

As illustrated FIG. 6F, the discharging toner having passed the primary transfer portion twice passes the charging portion again. Herein, as illustrated in FIG. 7, the charging power supply 3*a* applies a voltage of −1200 [V] to the charging roller 2*a*, and a potential difference ΔV34 is formed between a potential of the charging roller 2*a* and a potential of the photosensitive drum 1*a* such that the reversal toner is electrostatically moved to the charging roller 2*a*. Hence, the reversal toner is moved to the charging roller 2*a*, and the photosensitive drum 1*a* is charged with −700 [V] by electric discharge from the charging roller 2*a* while the reversal toner passes the charging portion.

Figure 6G:
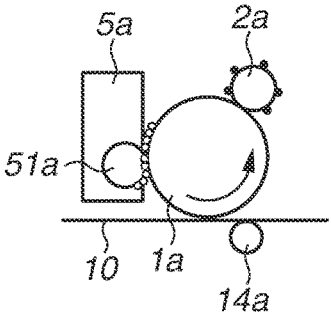

Subsequently, the discharging toner having passed the charging portion and remaining on the photosensitive drum 1*a* reaches a position where the developing roller 51*a* to which a voltage of −500 [V] is applied by the development power supply 52 contacts the photosensitive drum 1*a*. Herein, a potential difference ΔVb is formed between a potential of the developing roller 51*a* and a potential of the photosensitive drum 1*a*. With the potential difference ΔVb, the discharging toner remaining on the photosensitive drum 1*a* is electrostatically collected by the developing roller 51*a* as illustrated in FIG. 6G.

Then, the reversal toner moved to the charging roller 2*a* is collected by the cleaning unit 18 according to the operation and the control similar to those of the first exemplary embodiment, and the collection mode of the present exemplary embodiment ends.

According to the present exemplary embodiment, therefore, the discharging toner is collected by the developing unit 5*a* after passing the primary transfer portion twice. The controller circuit 23 as a control unit controls the drive source M, so that the photosensitive drum 1*a* is rotated by a driving force from the drive source M such that the discharging toner passes the primary transfer portion at least twice. This enables the reversal toner to be moved to the intermediate transfer belt 10 for a plurality of times, and the reversal toner charged with a polarity opposite to a normal charging polarity of the toner can be prevented from being collected by the developing unit 5*a* in the collection mode.

In the present exemplary embodiment, the developing roller 51*a* is separated from the photosensitive drum 1*a*, so that the discharging toner is not collected by the developing unit 5*a*. However, the present exemplary embodiment is not limited to such a configuration. For example, an absolute value of a potential difference between a potential of the developing roller 51*a* and a potential of the photosensitive drum 1*a* bearing the discharging toner may be decreased in a state in which the photosensitive drum 1*a* and the developing roller 51*a* contacts each other. In such a case, the discharging toner is not electrostatically collected by the developing unit 5*a*.

In the present exemplary embodiment, the reversal toner is moved twice from the photosensitive drum 1*a* to the intermediate transfer belt 10 in the primary transfer portion, and the reversal toner is moved twice from the photosensitive drum 1*a* to the charging roller 2*a* in the charging portion. However, the present exemplary embodiment is not limited thereto. For example, reversal toner may be moved twice from the photosensitive drum 1*a* to the intermediate transfer belt 10 in the primary transfer portion, and the reversal toner may not be moved to the charging roller 2*a* in a charging portion. In such a case, the charging roller 2*a* can be separated from the photosensitive drum 1*a* before the discharging toner passes the charging portion, and a voltage to be applied from the charging power supply 3*a* to the charging roller 2*a* can be set such that the reversal toner is not moved from the photosensitive drum 1*a* to the charging roller 2*a*.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016–231525, filed Nov. 29, 2016, which is hereby incorporated by reference herein in its entirety.

What is claimed is:

1. An image forming apparatus comprising:

a photosensitive member;

a charging member configured to form a charging portion by contacting the photosensitive member and to charge the photosensitive member;

a charging power supply configured to apply a voltage to the charging member;

an exposure unit configured to expose the photosensitive member;

a developing unit configured to develop a toner image on the photosensitive member by supplying toner;

an intermediate transfer member configured to form a transfer portion by contacting the photosensitive member and to receive the toner image transferred from the photosensitive member in the transfer portion;

a potential forming unit configured to form a potential of the intermediate transfer member in the transfer portion; and a control unit configured to control the potential forming unit and the charging power supply, wherein, the control unit is capable of executing an image forming mode in which an image is formed on a transfer medium that is conveyed and a collection mode in which discharging toner discharged onto the photosensitive member from the developing unit is collected by the developing unit while the image forming mode is not executed, and wherein, in a case where the control unit executes the collection mode, (i) the exposure unit forms a first potential on the photosensitive member and the developing unit discharges the discharging toner to a position where the first potential is formed, (ii) the control unit controls the potential forming unit such that toner, charged with a polarity opposite to a normal charging polarity of toner, out of the discharging toner is moved from the photosensitive member to the intermediate transfer member in the transfer portion, (iii) the control unit controls the charging power supply such that toner, charged with the polarity opposite to the normal charging polarity of toner, out of the discharging toner is moved from the photosensitive member to the charging member in the charging portion, and (iv) the developing unit collects the discharging toner remaining on the photosensitive member after the discharging toner passes the transfer portion and the charging portion.

2. The image forming apparatus according to claim 1, wherein, the control unit controls the potential forming unit to form a potential on the intermediate transfer member to move the toner charged with the polarity opposite to the normal charging polarity out of the discharging toner from the photosensitive member to the intermediate transfer member, the potential having a polarity same as the normal charging polarity and an absolute value greater than an absolute value of the first potential.

3. The image forming apparatus according to claim 1, wherein, the control unit controls the charging power supply to apply a voltage to the charging member to move the toner charged with the polarity opposite to the normal charging polarity out of the discharging toner from the photosensitive member to the charging member, the voltage having a polarity same as the normal charging polarity and an absolute value greater than an absolute value of the first potential.

4. The image forming apparatus according to claim 1, wherein toner remaining on the photosensitive member after transfer of the toner image from the photosensitive member to the intermediate transfer member in the transfer portion is not collected before reaching a position where the charging member and the photosensitive member contact each other, and is collected by the developing unit after passing the position where the charging member and the photosensitive member contact each other.

5. The image forming apparatus according to claim 1, wherein the potential forming unit includes:

a transfer member disposed at a position opposite to the photosensitive member via the intermediate transfer member; and a transfer power supply configured to apply a voltage to the transfer member, and wherein the application of the voltage to the transfer member by the transfer power supply forms a potential on the intermediate transfer member.

6. The image forming apparatus according to claim 1, wherein the collection mode is executed when an image forming operation is not performed.

7. The image forming apparatus according to claim 1, further comprising a cleaning unit disposed downstream of a second transfer portion, in which a toner image is transferred from the intermediate transfer member to the transfer medium, and upstream of the photosensitive member in a movement direction of the intermediate transfer member and configured to come into contact with the intermediate transfer member and collect toner remaining on the intermediate transfer member after passing through the second transfer portion, wherein, in a case of executing the collection mode, toner that has moved from the photosensitive member to the intermediate transfer member out of the discharging toner is collected by the cleaning unit.

8. The image forming apparatus according to claim 7, wherein the control unit controls the potential forming unit and the charging power supply after the discharging toner is collected by the developing unit in the collection mode such that toner that has moved from the photosensitive member to the charging member out of the discharging toner is moved from the charging member to the photosensitive member and then from the photosensitive member to the intermediate transfer member, and is then collected by the cleaning unit.

9. The image forming apparatus according to claim 8, wherein the developing unit includes a developing member configured to bear toner, wherein the developing member is contactable and separable with respect to the photosensitive member, and wherein, in a case of collecting the toner that has moved from the photosensitive member to the charging member out of the discharging toner by the cleaning unit, the developing unit separates the developing member from the photosensitive member while the toner that has moved from the charging member to the photosensitive member is passing through a position at which the developing member and the photosensitive member come into contact with each other.

10. An image forming apparatus comprising:

a photosensitive member;

a charging member configured to charge the photosensitive member;

a charging power supply configured to apply a voltage to the charging member;

an exposure unit configured to expose the photosensitive member;

a developing unit configured to develop a toner image on the photosensitive member by supplying toner;

an intermediate transfer member configured to form a transfer portion by contacting the photosensitive member and to receive the toner image transferred from the photosensitive member in the transfer portion; and a potential forming unit configured to form a potential of the intermediate transfer member in the transfer portion, wherein, in a case where a collection mode in which the exposure unit forms a first potential on the photosensitive member and the developing unit collects discharging toner discharged from the developing unit to a position where the first potential is formed is executed, the potential forming unit forms a potential having a polarity same as a normal charging polarity of toner and an absolute value greater than an absolute value of the first potential on the intermediate transfer member, and the charging power supply applies a voltage having a polarity same as the normal charging polarity and an absolute value greater than the absolute value of the first potential to the charging member.

11. The image forming apparatus according to claim 10, wherein, the charging member forms a charging portion by contacting the photosensitive member, and in a case where the collection mode is executed, the discharging toner is collected by the developing unit after passing the transfer portion and the charging portion.

12. The image forming apparatus according to claim 10, wherein, in a case where the collection mode is executed, the discharging toner is collected by the developing unit after passing the transfer portion at least twice in a state in which the potential forming unit forms a potential on the intermediate transfer member, the potential having a polarity same as the normal charging polarity and an absolute value greater than the absolute value of the first potential.

13. The image forming apparatus according to claim 10, wherein, the potential forming unit forms a potential on the intermediate transfer member to move toner charged with a polarity opposite to the normal charging polarity out of the discharging toner from the photosensitive member to the intermediate transfer member, the potential having a polarity same as the normal charging polarity and an absolute value greater than the absolute value of the first potential.

14. The image forming apparatus according to claim 13, further comprising a cleaning unit disposed downstream of a second transfer portion, in which a toner image is transferred from the intermediate transfer member to a transfer medium, and upstream of the photosensitive member in a movement direction of the intermediate transfer member and configured to come into contact with the intermediate transfer member and collect toner remaining on the intermediate transfer member after passing through the second transfer portion, wherein, in a case of executing the collection mode, toner that has moved from the photosensitive member to the intermediate transfer member out of the discharging toner is collected by the cleaning unit.

15. The image forming apparatus according to claim 10, wherein, the charging power supply applies a voltage to the charging member to move toner charged with a polarity opposite to the normal charging polarity out of the discharging toner from the photosensitive member to the charging member, the voltage having a polarity same as the normal charging polarity and an absolute value greater than the absolute value of the first potential.

16. The image forming apparatus according to claim 15, further comprising a cleaning unit disposed downstream of a second transfer portion, in which a toner image is transferred from the intermediate transfer member to a transfer medium, and upstream of the photosensitive member in a movement direction of the intermediate transfer member and configured to come into contact with the intermediate transfer member and collect toner remaining on the intermediate transfer member after passing through the second transfer portion, wherein the control unit controls the potential forming unit and the charging power supply after the discharging toner is collected by the developing unit in the collection mode such that toner that has moved from the photosensitive member to the charging member out of the discharging toner is moved from the charging member to the photosensitive member and then from the photosensitive member to the intermediate transfer member, and is then collected by the cleaning unit.

17. The image forming apparatus according to claim 16, wherein the developing unit includes a developing member configured to bear toner, wherein the developing member is contactable and separable with respect to the photosensitive member, and wherein, in a case of collecting the toner that has moved from the photosensitive member to the charging member out of the discharging toner by the cleaning unit, the developing unit separates the developing member from the photosensitive member while the toner that has moved from the charging member to the photosensitive member is passing through a position at which the developing member and the photosensitive member come into contact with each other.

18. The image forming apparatus according to claim 10, wherein toner remaining on the photosensitive member after transfer of the toner image from the photosensitive member to the intermediate transfer member in the transfer portion is not collected before reaching a position where the charging member and the photosensitive member contact each other, and is collected by the developing unit after passing the position where the charging member and the photosensitive member contact each other.

19. The image forming apparatus according to claim 10, wherein the potential forming unit includes:

a transfer member disposed at a position opposite to the photosensitive member via the intermediate transfer member; and a transfer power supply configured to apply a voltage to the transfer member, and wherein the application of the voltage to the transfer member by the transfer power supply forms a potential on the intermediate transfer member.

20. The image forming apparatus according to claim 10, wherein the collection mode is executed when an image forming operation is not performed.

21. An image forming apparatus comprising:

a photosensitive member;

an exposure unit configured to expose the photosensitive member;

a developing unit configured to develop a toner image on the photosensitive member by supplying toner;

an intermediate transfer member configured to form a transfer portion by contacting the photosensitive member and to receive the toner image transferred from the photosensitive member in the transfer portion; and a potential forming unit configured to form a potential of the intermediate transfer member in the transfer portion, wherein, in a case where a collection mode in which the exposure unit forms a first potential on the photosensitive member and the developing unit collects discharging toner discharged from the developing unit to a position where the first potential is formed is executed, the photosensitive member is rotated such that the discharging toner passes the transfer portion at least twice in a state in which the potential forming unit forms a potential on the intermediate transfer member, the potential having a polarity same as a normal charging polarity of toner and an absolute value greater than an absolute value of the first potential.

22. The image forming apparatus according to claim 21, wherein, in a case where the discharging toner passes the transfer portion, toner charged with a polarity opposite to the normal charging polarity out of the discharging toner is moved from the photosensitive member to the intermediate transfer member in the transfer portion.

23. The image forming apparatus according to claim 22, further comprising a cleaning unit disposed downstream of a second transfer portion, in which a toner image is transferred from the intermediate transfer member to a transfer medium, and upstream of the photosensitive member in a movement direction of the intermediate transfer member and configured to come into contact with the intermediate transfer member and collect toner remaining on the intermediate transfer member after passing through the second transfer portion, wherein, in a case of executing the collection mode, toner that has moved from the photosensitive member to the intermediate transfer member out of the discharging toner is collected by the cleaning unit.

24. The image forming apparatus according to claim 21, wherein the developing unit includes a developing member configured to bear toner, wherein the developing member is contactable and separable with respect to the photosensitive member, and wherein, in a case where the discharging toner is not collected by the developing unit, the developing unit separates the developing member from the photosensitive member.

25. The image forming apparatus according to claim 21, further comprising a charging member disposed upstream of a developing member and downstream of the transfer portion in a rotation direction of the photosensitive member and configured to charge the photosensitive member, wherein toner remaining on the photosensitive member after transfer of the toner image from the photosensitive member to the intermediate transfer member in the transfer portion is not collected before reaching a position where the charging member and the photosensitive member contact each other, and is collected by the developing unit after passing the position where the charging member and the photosensitive member contact each other.

26. The image forming apparatus according to claim 21, wherein the potential forming unit includes:

a transfer member disposed at a position opposite to the photosensitive member via the intermediate transfer member; and a transfer power supply configured to apply a voltage to the transfer member, and wherein the application of the voltage to the transfer member by the transfer power supply forms a potential on the intermediate transfer member.

27. The image forming apparatus according to claim 21, wherein the collection mode is executed when an image forming operation is not performed.

* * * * *